United States Patent [19]

Moore et al.

[11] 4,436,617

[45] Mar. 13, 1984

[54] FROTH FLOTATION ORE BENEFICIATION PROCESS UTILIZING ENHANCED GASIFICATION AND FLOW TECHNIQUES

[75] Inventors: Wilcy I. Moore, Glenolden; Ronald L. Tassoni, Milmont Park, both of Pa.

[73] Assignee: Cocal, Inc., Holmes, Pa.

[21] Appl. No.: 401,009

[22] Filed: Jul. 22, 1982

[51] Int. Cl.[3] ..... B03B 1/00

[52] U.S. Cl. ..... 209/3; 209/10; 209/170; 209/166; 209/17

[58] Field of Search ..... 209/3, 4, 5, 10, 12, 209/13, 17, 19, 161–172

[56] References Cited

U.S. PATENT DOCUMENTS

| | | | |
|---|---|---|---|
| 864,856 | 9/1907 | Norris . | |
| 873,586 | 12/1907 | Norris . | |
| 1,157,176 | 10/1915 | Owen | 209/167 |
| 1,176,428 | 3/1916 | Callow . | |
| 1,180,089 | 4/1916 | Thompson et al. . | |
| 1,187,772 | 6/1916 | Ohrn . | |
| 1,367,223 | 2/1921 | Applelqvist et al. . | |
| 1,456,563 | 5/1923 | Noviega | 209/161 |
| 1,869,241 | 7/1932 | Elie . | |
| 2,416,066 | 2/1947 | Phelps | 209/168 |
| 2,641,362 | 6/1953 | Remick | 209/155 |
| 2,746,605 | 5/1956 | Baum | 210/53 |
| 2,850,164 | 9/1958 | McCue | 209/171 |
| 2,922,521 | 1/1960 | Schranz | 209/163 |
| 2,970,689 | 2/1961 | Chang et al. | 209/12 |
| 3,015,396 | 1/1962 | Quast | 210/221 |
| 3,071,447 | 1/1963 | Bernhardi | 23/273 |
| 3,202,281 | 8/1965 | Weston | 209/166 |
| 3,298,519 | 1/1967 | Hollingsworth | 209/120 |
| 3,322,272 | 5/1967 | Evans et al. | 209/12 |
| 3,400,818 | 9/1968 | Tarjan | 209/170 |
| 3,428,175 | 2/1969 | Hukki | 209/164 |
| 3,446,353 | 5/1969 | Davis | 209/164 |
| 3,506,120 | 4/1970 | Wada et al. | 209/166 |
| 3,730,341 | 5/1973 | Mames et al. | 209/164 |
| 4,244,699 | 1/1981 | Smith et al. | 44/1 |
| 4,253,942 | 3/1981 | Gaumann | 209/17 |
| 4,270,926 | 6/1981 | Burk, Jr. et al. | 44/1 |
| 4,274,946 | 6/1981 | Smith et al. | 209/5 |
| 4,278,533 | 7/1981 | Hefner | 209/166 |
| 4,287,054 | 9/1981 | Hollingsworth | 209/170 |

FOREIGN PATENT DOCUMENTS

| | | | |
|---|---|---|---|
| 923338 | 8/1955 | Fed. Rep. of Germany | 209/172 |

*Primary Examiner*—Bernard Nozick

*Attorney, Agent, or Firm*—Howson and Howson

[57] ABSTRACT

Finely-divided ore is beneficiated in a froth floation process carried out in a closed vessel containing a medium on which a froth is formed as a result of the injection into the bottom of the vessel of a gasified slurry which percolates upwardly and circulates in the medium. A lighter fraction of the ore froths on the surface of the medium and is conveyed hydraulically into a receiver wherein the gaseous component is separated from the froth and is recycled through a compressor for mixing with an ore slurry supplied to mixing nozzles which inject the slurry into the medium. A heavier fraction of the ore sinks into the medium and is collected by and exhausted from the vessel through an underflow siphon located between the surface of the medium and the mixing nozzles. A wet scrubber flows a series of fluid jets in a horizontal grid pattern underneath the surface of the medium for limiting the upward percolation of the heavier fraction to the surface. The lighter ore fraction is dewatered downstream of the froth receiver.

32 Claims, 7 Drawing Figures

FROTH FLOTATION ORE BENEFICIATION PROCESS UTILIZING ENHANCED GASIFICATION AND FLOW TECHNIQUES

FIELD OF THE INVENTION

The present invention relates to processes and apparatus for beneficiating ores, and more particularly, the present invention relates to froth flotation processes and apparatus particularly suited for beneficiating coal from finely-divided raw input.

BACKGROUND OF THE INVENTION

Various types of processes have been utilized for beneficiating ores. The type of process utilized generally depends, not only on the nature of the ore, but also on the range of sizes of raw input to be processed. For instance, in beneficiating coal ore, the larger sizes of raw input are separated in jigs, dense medium baths, cyclones, and hydrocyclones. These processes have been used effectively to beneficiate coal ore having a size range in excess of 28 mesh. For smaller coal ore sizes, such as 28 mesh×0, froth flotation processes have usually been used to effect the desired separation of coal from refuse. Generally, a typical coal cleaning plant employs several of these processes in tandem to beneficiate a full range of raw input sizes.

As well known in the art, froth flotation processes utilize differences in the surface characteristics of the ore and the refuse to effect separation. When used to separate coal from refuse, the process takes place in a large vat or cell containing a separating medium which is composed largely of water with a small amount of fuel oil and froth promoter. The finely divided raw input is charged into the cell and circulated therein as compressed air is injected at spaced locations into the bottom of the cell. Because the coal particles are hydrophobic, and the refuse particles are hydrophilic, the air bubbles tend to associate with the coal particles, causing them to float to the surface of the cell and form a froth which is continuously skimmed and removed for further processing. The hydrophilic refuse particles settle to the bottom of the cell from which they are removed and conveyed to refuse handling equipment.

The conventional froth flotation process takes place in a series of open cells of whatever number maybe required to process a given amount of raw input per unit of time. Conventional froth flotation cells, however, have a number of disadvantages. For instance, most rely on the random motion of the bubbles through the separating medium to find and attach themselves to the coal particles in the raw input. As a result, some air escapes without ever contacting coal particles. Because compressed air is an expensive commodity, it should be apparent that a froth flotation process which utilizes compressed air more efficiently and effectively is highly desirable. Heretofore, several froth flotation stages have been required to overcome this inefficiency and to produce satisfactory yields.

Conventional froth flotation cells are open to the atmosphere. Because the frothing agents used are volatile, they escape into the ambient air around the cells and thus pollute the environment. Such volatility also limits the types of frothing agents and separating mediums which can be used in froth flotation processes.

Various techniques have been proposed in the art to improve the efficiency of the froth flotation process. For instance, one known process for improving aeration utilizes a nozzle to spray a raw input slurry or pulp at a high velocity onto the surface of the separating medium in a froth flotation cell. The flight of the pulp stream through the air and the turbulence created at its point of impact aerate the raw input. See U.S. Pat. Nos. 2,416,066 and 2,850,164. Mechanical mixing devices utilizing impellers, and hydraulic mixing utilizing baffling techniques have been proposed, as may be seen in U.S. Pat. No. 3,015,396. Other proposed systems, as disclosed in U.S. Pat. No. 3,400,818, include the use of vortex flow patterns along with air intake suction tubes to effect the desired aeration. U.S. Pat. No. 2,746,605 discloses a froth flotation process wherein air is injected into a slurry in a mixing nozzle. U.S. Pat. No. 2,641,362 discloses a slurry aeration nozzle wherein air is inducted into the flowing slurry. U.S. Pat. Nos. 4,253,942 and 1,367,223 are also of interest regarding devices for aerating slurries.

Other efforts have been made to improve the efficiency and effectiveness of hydraulic ore separation processes, including froth flotation processes.

For example, U.S. Pat. No. 2,641,362 discloses froth flotation apparatus wherein air is inducted into a recirculating flow of medium and conditioned slurry is admitted into the top of a separating vessel.

U.S. Pat. No. 3,428,175 discloses a froth flotation column having an enclosed upper end from which low density particles are removed by means of a vacuum source connected through a cyclone. An aerated and conditioned slurry is admitted tangentially into the column below the frothing section, and additional flotation air is admitted into the bottom of the column for movement upwardly and outwardly through a conical transition zone.

U.S. Pat. No. 3,071,447 discloses yet another type of hydraulic classifier in which closed apparatus is used to practice a crystallization process.

U.S. Pat. No. 3,730,341 discloses a froth flotation column wherein pretreated slurries are admitted into the bottom of a conical section and flowed upwardly in a shaped annular space formed between the inside wall of the column and a centrally located flow restrictor.

U.S. Pat. No. 4,253,942 discloses another type of flotation separator utilizing a flotation column wherein the flow of a pretreated slurry admitted adjacent to the bottom is regulated by means of the column configuration and a specially designed flow restrictor mounted therein.

U.S. Pat. No. 2,746,605 discloses a froth flotation device utilizing air injected into a pretreated slurry flowing into an open tank.

U.S. Pat. No. 4,287,054 discloses another type of froth flotation device wherein air is aspirated into flowing water which is injected into the base of a cylindrical column wherein feedstock is charged at an upper level.

U.S. Pat. No. 1,869,241 discloses a froth flotation column utilizing various types of flow restrictors which cooperate with an aerated flotation emulsion admitted at about the midpoint of the column to interact with ore charged downwardly into the column.

U.S. Pat. No. 1,176,428 discloses a froth flotation tank having a closed head space from which particle-carrying froth is exhausted by means of a vacuum. Air bubbles are admitted into the tank through a porous bottom, and the slurry is charged into the tank at a different location.

U.S. Pat. No. 3,446,353 discloses another type of froth flotation apparatus wherein a slurry mixture is flowed horizontally into the lower end of a tank and impinges upon an upstanding baffle near the bottom of the tank.

U.S. Pat. No. 1,187,772 discloses a froth flotation process and apparatus wherein feedstock is admitted downwardly into the upper end of a tank simultaneously with the injection of a frothing agent and a carrying medium.

U.S. Pat. Nos. 864,856 and 873,586 both disclose vertical column devices for beneficiating ores.

Other separating devices of interest are disclosed in U.S. Pat. Nos.: 3,506,120; 2,922,521; 3,202,281; and 1,180,089.

Coal cleaning processes of interest are disclosed in U.S. Pat. Nos.: 4,244,699; 4,274,946; and 4,270,926.

While the above-noted patented processes and apparatus may function satisfactorily for their intended purposes, none is entirely satisfactory from both an efficiency and environmental standpoint.

OBJECTS OF THE INVENTION

With the foregoing in mind, a primary object of the present invention is to provide an improved froth flotation process for beneficiating ores.

It is another object of the present invention to provide a novel process and apparatus for improving the efficiency with which ores are beneficiated in a froth flotation process.

It is a still further object of the present invention to provide unique apparatus for practicing a froth flotation ore beneficiating process in an environmentally satisfactory manner.

SUMMARY OF THE INVENTION

More specifically, the present invention provides novel apparatus for practicing an improved froth flotation ore beneficiating process in an efficient and environmentally satisfactory manner. To this end, an aqueous slurry composed of a finely-divided raw input and frothing agents is mixed with air under pressure in a mixing nozzle and injected into a fluid medium contained in a closed vessel. The aerated slurry percolates upwardly through the fluid medium around an upwardly open underflow siphon to establish the desired circulation in the fluid medium. A lighter fraction of the raw input forms on the surface of the fluid medium a froth which is withdrawn into a receiver wherein the froth is separated into gaseous and solids-containing liquid components. A heavier fraction sinks in the fluid medium and is collected in the underflow siphon through which it is withdrawn from the vessel for further processing. The air separated from the froth in the receiver is recycled through a compressor and is injected into incoming slurry prior to ejection of the aerated slurry into the vessel. The solids-containing liquid component is withdrawn from the receiver for further separation. A scrubbing grid extends horizontally across the vessel below the surface of the fluid medium and ejects fine streams of water to control the upward percolation of the heavier fraction in the fluid medium. The level of the fluid medium in the vessel is detected and controlled by regulating the outflow of medium and heavier fraction through the underflow siphon. The vessel may be connected in tandem with a like vessel to provide a multi-stage froth flotation process. The apparatus is particularly suited for separating finely-divided raw coal input (28 mesh×0) into a coal-rich lighter fraction and a refuse-rich heavier fraction.

BRIEF DESCRIPTION OF THE DRAWINGS

The foregoing and other objects, features and advantages of the present invention should become apparent from the following description when taken in conjunction with the accompanying drawings, in which.

DESCRIPTION OF THE PREFERRED PROCESS AND APPARATUS

Figure 1:
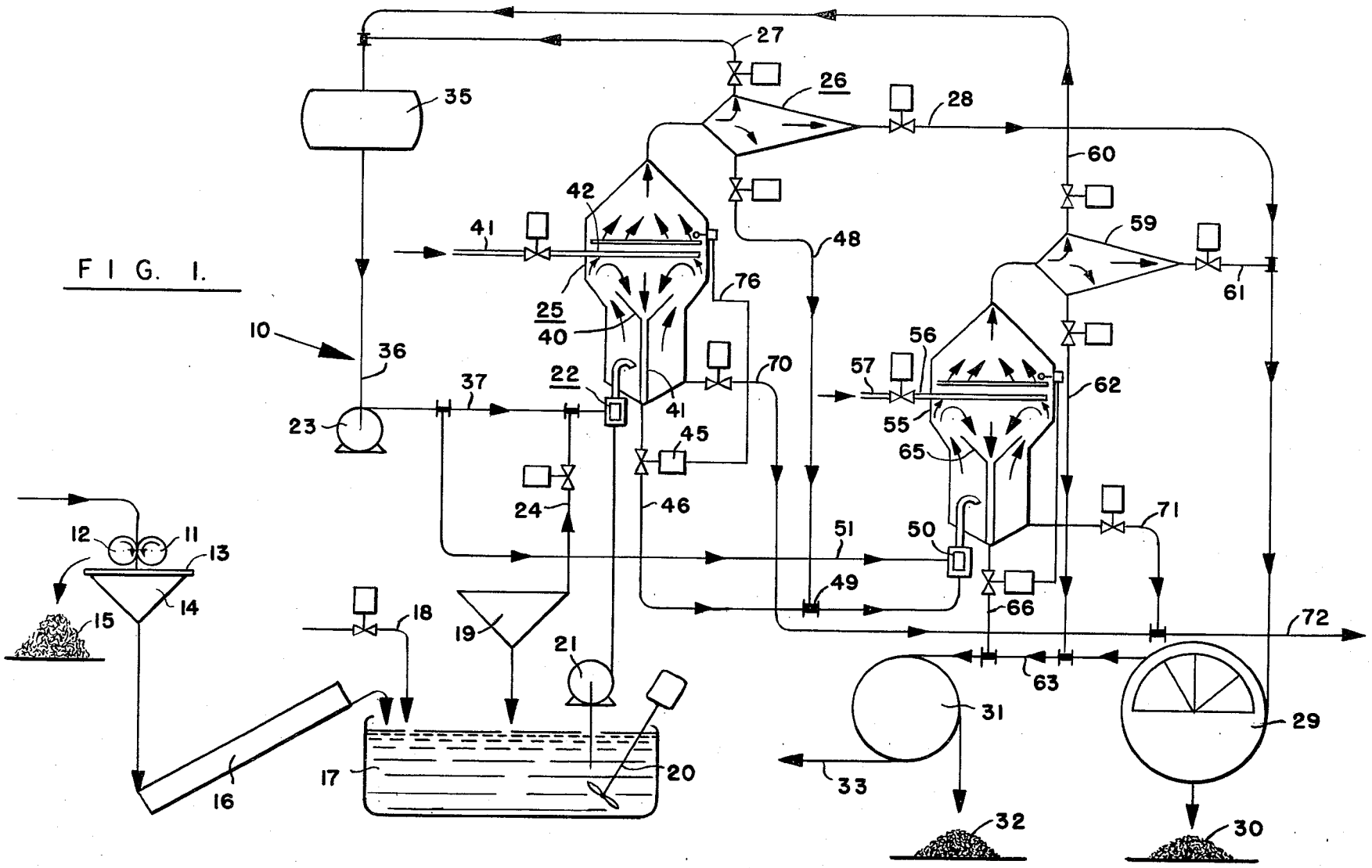
FIG. 1 is a schematic flow diagram illustrating the ore beneficiating process embodying the present invention.

Referring now to the drawings, FIG. 1 illustrates schematically a preferred embodiment of the improved ore beneficiating process 10 of the present invention. While the process 10 may be used to beneficiate a number of different types of ores, it is particularly suited for beneficiating coal ore from associated mining refuse. With some modifications, as should be apparent to those skilled in the art, the process 10 could be adapted to beneficiate other ores, such as phosphates, from associated refuse.

Referring again to FIG. 1, raw input is charged downwardly between a pair of crushing rollers 11 and 12 onto a screen 13 located above a hopper 14. The screen 13 retains raw input of a +28 mesh size from which the +28 mesh material is removed and deposited in a pile 15. The 28 mesh×0 raw input is advanced by a conveyor 16 and is charged into a mixing vat or tank 17 which, in the present instance, contains water supplied via the valved supply pipe 18. A frothing agent is contained within a supply tank 19 and is metered into the mixing vat 17 where it is stirred continuously by a mixer 20 to form a homogeneous slurry. The slurry is pumped from the mixing vat 17 by a pump 21 which is connected to a mixing nozzle assembly 22. An air compressor 23 supplies air under pressure to the mixing nozzle assemble 22, or if desired, frothing agent may be pumped to the mixing nozzle 22 through a valved pipe 24.

As will be discussed in greater detail hereinafter, separation of the slurry into a lighter coal fraction and a heavier refuse fraction occurs within a separating column or vessel 25. In the separating column 25, the lighter coal-rich fraction forms a froth which is withdrawn from the top of the separating column 25 and conveyed into a receiver or separator 26 wherein the froth is separated into a gaseous air component and a solids-containing liquid component. The air is withdrawn from the receiver 26 via the valved line 27. The coal-rich solids-containing liquid component is exhausted from the receiver 26 via a valved line 28 which is connected to a vacuum filter 29 which, in operation, dewaters the inflow and deposits coal particles in a pile 30. The liquid output from the filter is subjected to further downstream dewatering in any one of several types of dewatering devices 31, such as a dewatering cyclone, rotary sieve, etc. The solids output from the dewatering equipment 31 is deposited in a pile 32, and the liquid component is flowed via line 33 to a settling pond or the like.

The air separated from the froth in the froth receiver 26 is recycled. To this end, the air return line 27 is connected to a surge tank 35 which, in turn, is connected via line 36 to the suction side of the air compressor 23. The discharge side of the air compressor 23 is connected, as noted heretofore, via line 37 to the mixing nozzle 22.

As will be discussed more fully hereinafter, the heavier refuse-rich fraction of the aerated slurry circulates in a predetermined flow pattern in the separating column 25 and is collected in an underflow siphon 40 mounted at the top of an upstanding hollow stem 41 projecting upwardly from the bottom of the separating column 25. A water scrubber or grid 42 extends horizontally across the separating column 25 below the level of the medium contained therein and is supplied with water via valved line 41. The heavier refuse-rich component collected in the underflow siphon 40 is conveyed from the separating vessel 25 via the hollow stem 41 and through a valve 45 connected in a line 46 which is connected, either to a refuse pile or, as in the illustrated embodiment, connected to a secondary froth flotation stage. The function of the valve 45 is to control the rate at which the refuse-rich fraction is withdrawn from the vessel 25 and thereby to control the operating level of the fluid medium contained within the vessel 25.

In the embodiment illustrated in FIG. 1, the refuse-rich underflow withdrawn from the vessel 25, and the heavier component of the froth separated in the froth receiver 26, are further processed. To this end, the bottom of the froth receiver 26 is connected via valved line 48 to a Tee 49 in the line 46 from the first separating column 25. The combined flow through the lines 46 and 48 is supplied to the mixing nozzle assembly 50 which, like the nozzle assembly 22, is supplied with compressed air via a compressed air line 51. The mixing nozzle assembly 50 ejects the aerated slurry into the bottom of a secondary separating column 55 which is like in construction to the separating column 25 described heretofore. The separating column 55 has a wet scrubber or grid 56 which is supplied with water via valved line 57. The upper end of the separating column 55 is connected to a froth receiver 59 like in construction and operation to the receiver 26.

Air separated in the receiver 59 is flowed via valved line 60 to the air surge tank 35. The lighter coal-rich component of the froth separated in the receiver 59 is flowed via valved line 61 to the filter 29. The heavier component of the separated froth is flowed via the valved line 62 to a conduit 63 which is connected to the dewatering equipment 31. The underflow siphon 65 of the secondary separating column 55 is connected to the dewatering equipment 31 via line 63 and valved outlet 66.

Each separating column 25 and 55 is provided with a valved drain connected through lines 70 and 71 to a common header 72. The drains are employed to remove heavier particles from the insides of the separating columns 25 and 55 and to transport the same to a refuse pile, not shown.

Figures 2, 3, 4, 5:
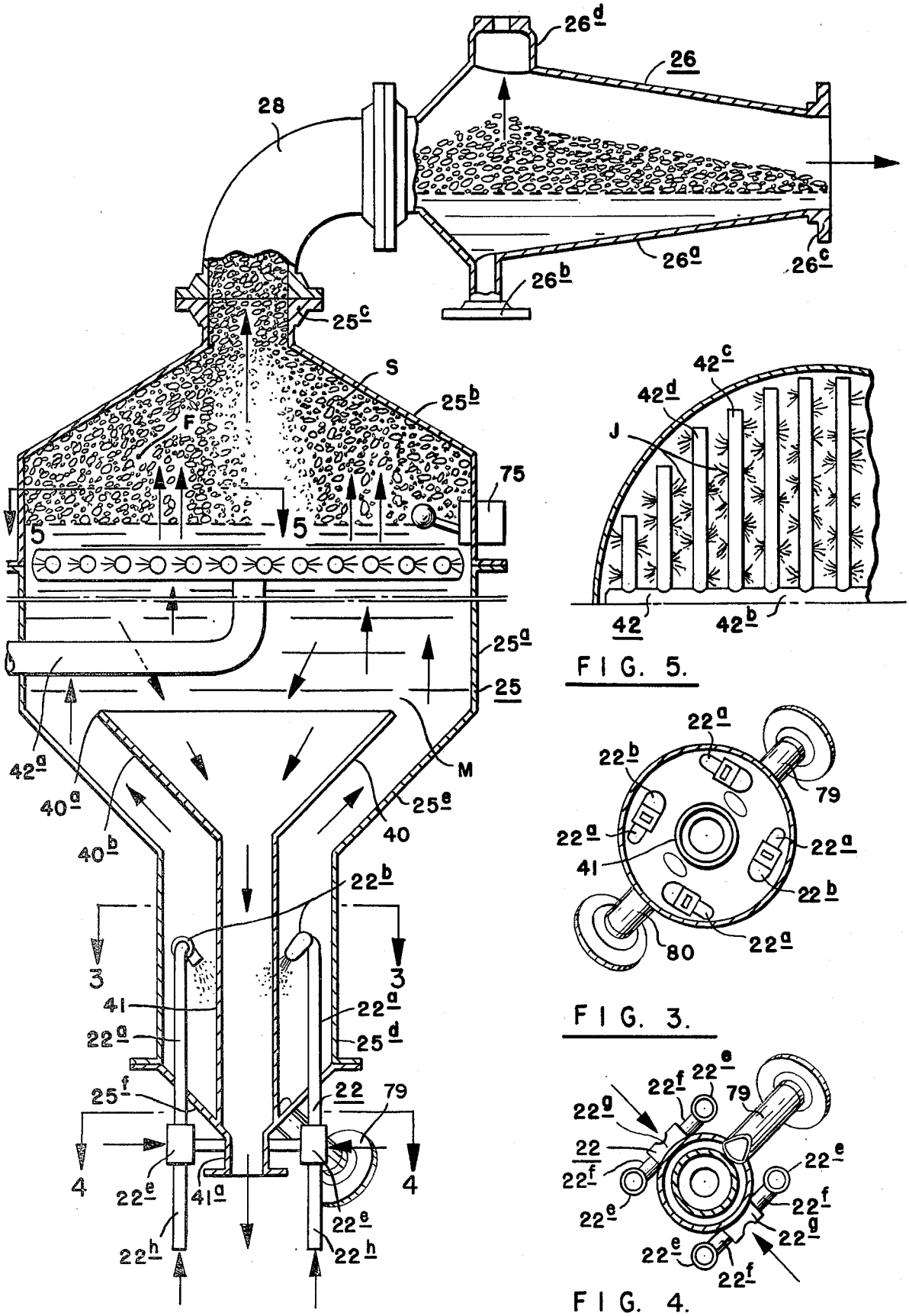
FIG. 2 is a vertical sectional view of a froth flotation column used in the process of FIG. 1.
FIG. 3 is a sectional view taken on line 3—3 of FIG. 2.
FIG. 4 is a sectional view taken on line 4—4 of FIG. 2.
FIG. 5 is a sectional view taken on line 5—5 of FIG. 2.

The separating column 25 is specially designed to cooperate in a novel manner with the other components of the process 10 to separate efficiently coal from refuse. To this end, as best seen in FIG. 2, the separating column 25 has a cylindrical vertical wall **25*a* which contains a fluid medium at an operating level L. The fluid medium M is composed of the aerated conditioned slurry and its various components, including the air bubbles, and the circulating ore fractions contained within the column or vessel 25. The upper end of the vessel 25 is closed by a frusto-conical hood 25*b* which terminates in a central outlet 25*c*. The hood 25*b*** provides a head space S above the fluid medium level L for accommodating the froth F which forms on the surface of the fluid medium M.

In order to maintain the fluid medium level L within a predetermined operating range, a level detector 75 is mounted in the separator wall **25*a*. The level detector 75 is coupled via control line 76 to the underflow siphon valve 45 for controlling the downward flow through the underflow siphon 40. See FIG. 1. Thus, by employing conventional control mechanisms, the fluid level detector 75 functions to increase the rate of flow of underflow through the underflow siphon 40 in response to increases in the level L of the fluid medium M and to decrease the flow of underflow through the underflow siphon 40** in response to decreases in the level L, thereby maintaining the level L of the fluid medium M within a predetermined operating range.

To ensure collection of the generated refuse, the underflow siphon 40 is provided with an enlarged entrance **40*a* at the upper end of a funnel-shaped wall 40*d* which is connected to the upper end of the hollow stem 41. The aerated slurry is channeled along the stem 41 by a cylindrical lower wall 25*b* of the column 25 which surrounds the stem 41 and which is located inwardly of the outer periphery of the underflow siphon entrance 40*a*. The upper end of the lower cylindrical wall 25*b* is connected to the lower end of the upper cylindrical wall 25*a* by a tapered transition wall 25*e* which extends substantially parallel to the underside of the funnel-shaped wall 40*d* of the underflow siphon 40**.

The bottom of the separating column 25 is provided with a downwardly inclined wall **25*f* connected to at least one, and preferably a pair of drains 79 and 80. The lower end of the underflow siphon stem 41 is connected to an outlet orifice 41*a* provided in the bottom wall 25*f* of the separating column 25. As noted heretofore, the purpose of the underflow siphon 40 is to withdraw from the vessel 25 the heavier refuse-rich fraction which tends to sink centrally in the separating column 25 due to the currents created therein, and the purpose of drains 79 and 80 are to withdraw solids which sink before reaching the entrance to the underflow siphon 40**.

The coal-rich froth F accumulates in the head space S and is flowed through elbow 78 into the receiver 26. In the illustrated embodiment, the receiver 26 has a frusto-conical tapered wall **76*a* disposed horizontally and extending between a bottom drain 26*b* and a lateral outlet 26*c*. The bottom drain 26*b* is connected via the valved drain line 48 to either a middlings pile or further separating columns such as the column 55 illustrated in FIG. 1. The receiver outlet 26*c* is connected via the valved line 28 to the vacuum filter 29 illustrated in FIG. 1. A protrusion 26*d* in the upper wall of the receiver 26** is connected to the air return line 27. The receiver 26 functions to separate by gravity the gaseous component of the froth F, i.e. the air, from the non-gaseous component, i.e. the solids-containing liquid or slurry which remains after the air is withdrawn. Because of the incline of the wall 26*a*, the lighter component of the remaining slurry, which is substantially free from refuse, flows through the outlet 26*c* to the filter 29. The heavier component of the remaining slurry which may include some refuse associated with coal, is withdrawn via the drain 26*b* and is either further processed, as illustrated, or is discarded.

For the purpose of limiting the amount of heavier fraction which reaches the surface L of the fluid medium M, the scrubbing grid 42 is provided. As best seen in FIG. 5, the scrubbing grid 42 comprises a laterally and upwardly curved supply pipe 42*a* which opens into a horizontally disposed header 42*b* extending diametrically across the separating column 25 below the level L of the fluid medium M. A plurality of spray tubes extend laterally from the header 42*b*, and each has a series of small orifices, from which small jets of fluid, such as the jets J, are flowed in a horizontal plane. Preferably, the orifices are located in the lateral tubes 42*d* and 42*c* in each quadrant in such a manner as to flow the jets J in the same direction in that quadrant. The horizontally flowing jets J operate in conjuction with the circulation established within the separating column 25 to limit the amount of heavier refuse-rich fraction which reaches the surface L of the fluid medium M. As a result, only the lighter coal-rich fraction tends to pass upwardly through the scrubber 42 for frothing on the surface L. The heavier refuse-rich fraction tends to be driven downwardly toward the entrance 40*a* of the underflow siphon 40 for collection and withdrawal from the separating column 25. While the scrubbing grid 42 enhances the quality of the froth F, it may be eliminated if a higher ash coal product is acceptable.

In order to establish the desired circulation within the separating column 25, the aerated and conditioned raw input slurry is ejected into the fluid medium in the separating column 25 adjacent its lower end. For this purpose, a plurality of nozzle tubes 22*a* project upwardly through the bottom wall 25*f* of the separator 25 and mount at their upper ends downwardly directed deflectors 22*b*. In the illustrated embodiment, four nozzle tubes 22*b* are spaced apart about the periphery of the underflow siphon stem 41, and their deflectors 22*b* are arranged to cause the aerated slurry ejected therefrom to be directed in a generally downward direction with respect to the stem 41. Preferably, the deflectors 22*b* are mounted to the nozzle tube 22*a* by means of an adjustable coupling 22*c* to afford limited adjustment. See FIGS. 6 and 7.

After being ejected downwardly into the lower end of the separating column 25, the aerated slurry forms bubbles which percolate upwardly with the slurry in the annular space between the underflow siphon stem 41 and the lower wall 25*d* of the column 25 and then outwardly between the underflow siphon wall 40*b* and tapered wall 25*e* of the separating column 25. In this region, the turbulence of the upwardly percolating aerated slurry is attenuated and excess air is purged, so that by the time the upwardly percolating bubbles and slurry reaches the level of the siphon entrance 40*a*, they begin to flow in a laminar condition toward the surface L of the fluid medium M. By the time the upwardly percolating bubbles have entered the separating zone defined by the cylindrical wall 25*a* they have formed a sufficiently strong bond with the hydrophobic coal particles so that they tend to continue a vertical migration through the scrubber grid 42 to form the froth F on the surface L of the fluid medium M. At the same time, the hydrophilic refuse-rich particles carried upwardly by the upflowing currents, tend to sink downwardly in the fluid medium M and to fall toward the entrance 40*a* of the underflow siphon 40. The jet streams J emanating from the scrubber grid 42 assist in preventing significant quantities of the refuse-rich heavier particles from reaching the surface L of the fluid medium M by knocking loose any bubbles which may not have formed a strong affinity with the particles, such as when a particle may comprise bony coal, i.e. part coal and part refuse.

Figure 6:
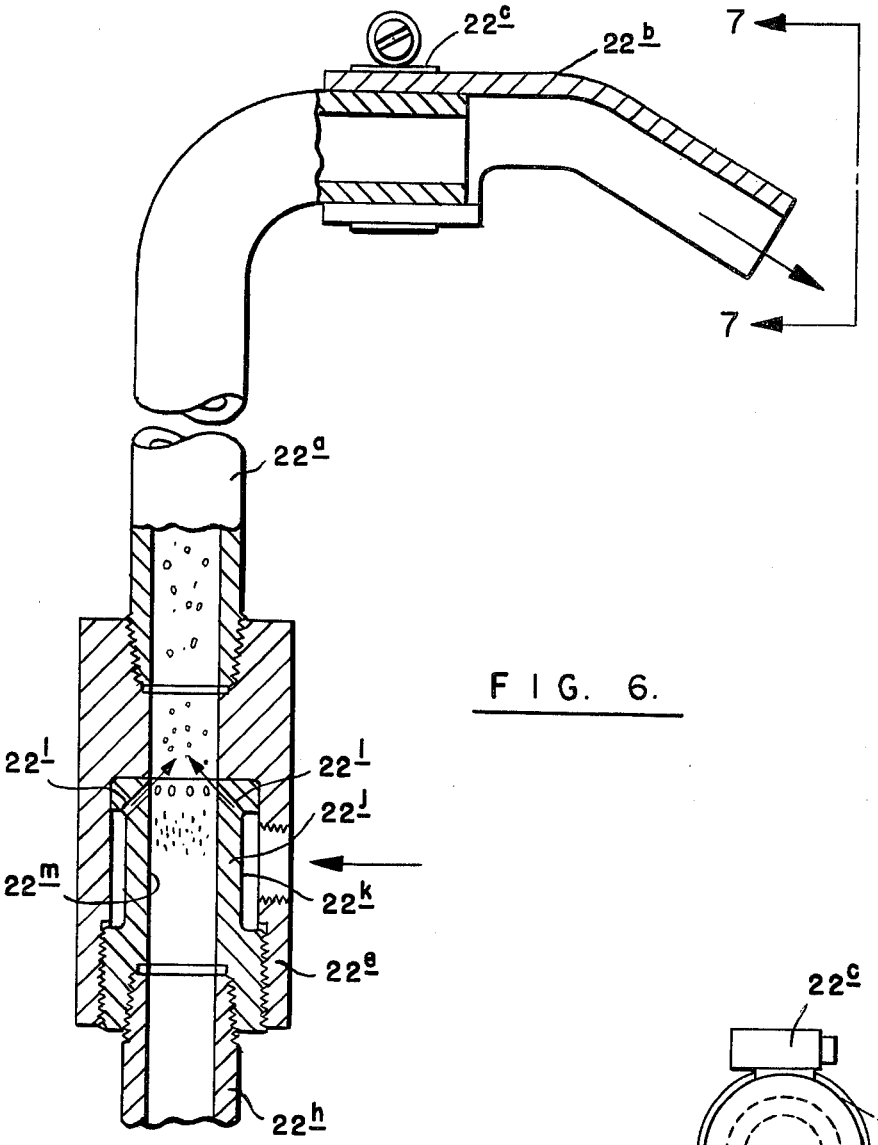
FIG. 6 is a greatly enlarged, partially-sectioned view of one of the mixing nozzles utilized in the apparatus illustrated in FIG. 2.
Figure 7:
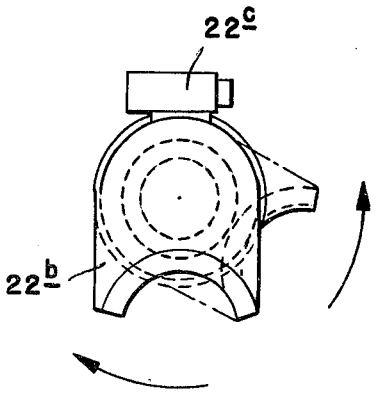
FIG. 7 is a view taken on line 7—7 of FIG. 6 to illustrate various adjusted positions of a flow deflector on the illustrated mixing nozzle.

The desired circulation of the aerated slurry and medium M in the separating column 25 is promoted by the continuous withdrawal through the underflow siphon 40 of the sinking refuse-rich particles and surrounding fluid medium M. By controlling the rate of withdrawal through the underflow siphon 40, the fluid level L and overall fluid balance in the separating column 25 can be controlled while simultaneously inducing in the separating column 25 the desired circulation which may be characterized as toroidial inward rolling motion For the purpose of mixing the slurry formed in the mixing tank 17 with air prior to ejection from the nozzle tubes 22*b*, the nozzle assembly 22 has a mixing chamber fitting 22*e* at the base of the nozzle tube 22*a*. Preferably, as illustrated in FIG. 4, each mixing chamber 22*e* is connected by a nipple 22*f* to a common Tee 22*g* which, in turn, is connected to the supply line 37 leading from the air compressor 23. As best seen in FIG. 2, the slurry is flowed upwardly by the pump 21 through a manifold (not shown) to slurry supply tubes 22*h* connected to the bottom of the mixing chamber 22*e*. As best seen in FIG. 6, the mixing chamber fitting 22*e* is provided with an interior insert 22*j* having a recessed periphery 22*k* providing a peripheral air chamber. A plurality of orifices 221, 221 provide communication between the chamber 22*k* and the bore 22*m* which extends through the length of the mixing chamber fitting 22*e*. Preferably, the orifices 221 incline in the direction of movement of the slurry through the mixing chamber 22*e*. As a result, compressed air fed laterally leftward into the air chamber 22*k* flows inwardly through the orifices 22*l* to impact on the slurry flowing upwardly through the bore 22*m*. The action of the air on the particles entrained in the slurry enhances the surface reactions which occur between the particles and the air and frothing agent.

In order to insure optimum performance of the disclosed process and apparatus to beneficate coal ore, certain operating conditions should be observed. First of all, the raw input should be classified or screened to a size not larger than 12 mesh and more preferably to a size range of about 200 mesh×0. The slurry formed in the mixing tank 17 should comprise 20 to 30% of raw input solids on a weight basis. This is because when the solids content of the slurry is below 20%, too much water is introduced into the system, and when the solids content is above 30%, the resulting slurry is too viscous to be handled efficiently. Preferably, the raw input comprises about 25%, by weight, of the total weight of the slurry. It should be understood, of course, that in the steady state operation of the separating column, the aerated raw input forms the fluid medium M.

While various frothing agents, modifiers, activators, depressants, and collectors may be used as indicated by the nature of the ore to be processed as known in the art, a preferred frothing agent for coal ore includes the combination of about 1½% by weight, of No. 2 fuel oil and about 0.1% of butoxy ethoxy proponal.

The compressed air produced by the compressor 23 is supplied to the mixing nozzle chambers **22*k* at a pressure in a range of about 30 psig. to about 50 psig. when the nozzle configuration illustrated in FIG. 6 is utilized. Air consumption at this pressure is about 0.2 to 0.3 cfm. when the slurry flow rate is about 20 pounds per minute. The slurry formed in the mixing tank 17 is supplied by the pump 21 to the mixing nozzle chambers 22*e*** at a pressure in a range of about 20 psig. to about 30 psig.

The separator 25 causes the aerated slurry to dwell within the fluid medium for a predetermined time interval as it percolates upwardly. For coal ore, a dwell time of less than about 30 seconds has been found adequate. By way of example, a separating column 25 capable of handling about 200 gallons per minute of raw input slurry, should have a cylindrical section having an axial dimension of about 3 feet and a diameter of about 5 feet. Depending upon the total volume of raw input, a series of separating columns 25 may be ganged in parallel with one another as well as being ganged in tandem such as illustrated in FIG. 1.

In order to insure that the proper flow conditions are created inside the separating column 25 and to control the withdrawal of the refuse-rich material from the separating column 25, the underflow siphon entrance **40*a* should have an area at least half as great as the cross-sectional area of the cylindrical portion of the separating column 25. In addition to collecting the refuse-rich material, the underside of the tapered wall 40*b* of the underflow siphon 40 functions to attenuate turbulence in the upwardly percolating slurry, thereby promoting laminar flow in the upper or cylindrical portion of separating column 25. The underflow siphon entrance 40*a* should be located below the upper level L of the fluid medium M about two (2) diameters, based on the diameter of the underflow siphon entrance 40*a*. As noted heretofore, the fluid medium level L is regulated in the steady state by varying the rate of withdrawal of refuse-rich solids through the underflow siphon 40**.

Tests have revealed that the process of the present invention can be used, not only to beneficiate coal more efficiently, but also to reduce the sulfur content of the beneficiated coal. To this end, laboratory tests were conducted utilizing a scaled down version of a separating column differing from the illustrated separator 25 by the absence of a scrubber grid and an upwardly tapered reduced-diameter lower portion surrounding the nozzle assembly. The laboratory column had a cylindrical section with an overall length of 22 inches, an inside diameter of 6 inches, and an underflow siphon having an opening diameter of 4½ inches located 10 inches up from the bottom of the chamber. The aerated slurry mixture was injected into the separating chamber through a single mixing nozzle, located about 4 to 5 inches up from the bottom of the column. The raw input slurry was flowed into the mixing nozzle at a rate of 2 gallons per minute and had a solids content of about 25%. The air pressure at the mixing nozzle was 30 psig., and the supply pressure of the slurry of the mixing nozzle was 20 psig. The frothing agent noted heretofore was used. The air flow was at a rate of about 0.25 cfm.

The raw or head coal was obtained from various coal seams including western bituminous coal from the Pocohantas and Hanna seams, and eastern anthracite coal from the Pitt and Kittany seams. The head coal, or raw input, had been screened to a size range of 200 mesh×0 prior to formation of the slurry. After steady state conditions had been established in the separating column, the resulting coal-rich froth was heated to evaporate all moisture and was analyzed to determine its percentage of ash, sulfur, volatiles, and carbon. The results of the test are set forth in TABLE I below.

TABLE I

| COAL SEAM | ASH (PER-CENT) | SUL-FUR (PER-CENT) | VOLA-TILES (PER-CENT) | CAR-BON (PER-CENT) |
|---|---|---|---|---|
| POCAHONTAS | | | | |
| Head | 4.5 | 0.60 | 18.0 | 70.0 |
| Clean | 2.0 | 0.50 | 20.0 | 77.0 |
| HANNA | | | | |
| Head | 27.0 | 0.60 | 37.0 | 38.0 |
| Clean | 10.9 | 0.68 | 45.0 | 44.0 |
| PITT | | | | |
| Head | 8.0 | 1.51 | 36.63 | 56.1 |
| Clean | 4.5 | 1.32 | 39.37 | 55.8 |
| KITTANY | | | | |
| Head | 12.9 | 3.52 | 35.6 | 51.5 |
| Clean | 6.4 | 2.09 | 38.3 | 55.3 |

From the above table, it may be seen that in each of the coal seams analyzed, very substantial reductions were achieved in the ash content of the beneficiated coal. Except for the Hanna seam, significant reductions in sulfur content were also realized. The percentage of volatiles in each sample increased, and with the exception of the Pitt seam, the percentage of carbon in the beneficiated coal increased. Thus, it should be apparent that the separating column functions effectively and efficiently to clean raw coal input in the size ranges traditionally handled by froth flotation equipment.

The present invention provides a number of advantages in addition to those noted heretofore. For instance, the entire system can be arranged in a relatively compact plant, thereby enabling the plant to be transported as a package plant. Also, because the separation occurs in a closed system, more highly volatile, even combustible, frothing agents and/or slurry fluids may be used. For example, with certain ores, benzene and gasoline may be used in lieu of the fuel oil used to beneficiate coal ore.

Thus, in view of the foregoing, it should be apparent that the present invention now provides an improved method and apparatus for beneficiating ores in an efficient and environmentally satisfactory manner.

While a preferred method and apparatus have been described in detail, various modifications, alterations and changes may be made without departing from the spirit and scope of the present invention as defined in the appended claims.

I claim:

1. Apparatus for beneficiating pulverized ore, comprising:

a closed vessel adapted to contain fluid at a predetermined operating level, an underflow siphon having an upwardly-opening entrance located below said fluid level, means for injecting into said fluid below said siphon an ore slurry including a frothing agent and a gas, said injecting means cooperating with said fluid in said vessel and said underflow siphon to establish a circulatory pattern in said vessel for causing a first ore fraction to froth on said fluid and a second ore fraction to sink into said underflow siphon, means connected to said underflow siphon for exhausting said second ore fraction from said vessel, and means connected to said vessel above said fluid level for separating the same into a gaseous component and a non-gaseous component, whereby pulverized ores can be beneficiated in a continuous process.

2. Apparatus according to claim 1 including means connected to said froth separating means for compressing said gaseous component and reintroducing the same to said injecting means.

3. Apparatus according to claim 1 including means connected to said froth separating means for further separating said non-gaseous component to yield ore solids and a liquid.

4. Apparatus according to claim 1 including a grid mounted in said vessel below said fluid level and above said siphon entrance for flowing plurality of fluid streams transversely of said vessel for restricting the flow of said second ore fraction to the surface of the fluid.

5. Apparatus according to claim 1 wherein said vessel has an inclined bottom wall surrounding said underflow siphon, and including means providing a valved drain in said bottom wall.

6. Apparatus according to claim 1 wherein said vessel has a predetermined cross-sectional area, and said underflow siphon entrance has a corresponding area at least about half as large as said cross-sectional area of said vessel.

7. Apparatus according to claim 1 wherein said underflow siphon entrance is located closer to said operating level than to said gasified slurry injection location.

8. Apparatus according to claim 1 wherein said vessel has a shaped hood overlying said fluid in said vessel and providing a head space for froth, a duct connecting said hood to said separating means, and means connected to said separating means for creating therein a pressure lower than the pressure in said head space for conveying the froth into said separating means.

9. Apparatus according to claim 1 wherein said injecting means includes a nozzle having a mixing chamber, means for flowing said ore slurry into said mixing chamber, and means for injecting said gas under pressure into said ore slurry as it flows through said mixing chamber.

10. Apparatus according to claim 1 including a plurality of nozzles like said one nozzle spaced apart around said underflow siphon with each nozzle being positioned to eject said ore slurry in a downward direction as it exits the nozzle.

11. Apparatus according to claim 10 wherein said underflow siphon entrance flares outwardly and upwardly from an upstanding tube located within said vessel, and said nozzles are arranged adjacent said tube.

12. Apparatus according to claim 11 wherein said vessel has a lower wall surrounding said underflow siphon tube and flaring outwardly therefrom below said flared entrance to said underflow siphon for minimizing the turbulence of the gasified slurry as it ascends in said vessel.

13. Apparatus according to claim 1 including valve means connected to said underflow siphon exhausting means for controlling the rate of withdrawal of said second ore fraction from said vessel and thereby regulating said fluid operating level.

14. Apparatus according to claim 13 including means for detecting said fluid level in said vessel, and control means connecting said level detecting means and said valve means for automatically regulating said fluid level in said vessel.

15. A method of beneficiating ores, comprising the steps of:

classifying said ore to a predetermined size range;

mixing said classified ore with a frothing agent to form a slurry;

flowing said slurry through a mixing chamber;

injecting gas under pressure into said slurry in said mixing chamber to form a gasified slurry;

establishing in a closed vessel a fluid medium at a predetermined operating level;

expelling said gasified slurry into said fluid medium below said level for percolating through the medium and causing a first ore fraction to froth on the surface of the medium;

collecting in an underflow siphon located below the surface of the medium a second ore fraction tending to sink in the fluid medium;

withdrawing said froth from said vessel;

separating said froth into a gaseous component and a non-gaseous component:

compressing said gaseous component and reinjecting it into said slurry in said mixing chamber;

separating said non-gaseous component into ore solids and a liquid; and exhausting said second ore fraction from said vessel through said underflow siphon.

16. The method according to claim 15 including the step of flowing a fluid transversely in the vessel in a grid pattern below the surface of said fluid medium for controlling the percolation of said second ore fraction in said fluid medium.

17. The method according to claim 15 including the steps of filtering said first ore fraction to produce ore solids and dewatering said second ore fraction to produce ore middlings.

18. The method according to claim 15 including the steps of repeating said flowing, injecting, establishing, expelling, collecting, withdrawing, froth separating, compressing, and non-gaseous separating steps on at least said second ore fraction collected in the underflow siphon of said first-mentioned vessel.

19. The method according to claim 15 including the steps of detecting the level of the fluid medium in the vessel, and regulating said level by controlling the rate of exhausting of said second ore fraction from said vessel.

20. The method according to claim 15 wherein said classifying step includes the step of screening said ore to a size range of about 200 mesh$\times$0.

21. The method according to claim 15 wherein said slurry has a solids content in a range of about 20% to about 30% on a weight basis, based on the total weight of the slurry.

22. The method according to claim 15 wherein said gas includes air injected into said slurry at a pressure in a range of about 30 psig to about 50 psig.

23. The method according to claim 15 wherein said slurry is expelled into said fluid medium at a pressure in a range of about 20 psig to about 30 psig.

24. The method according to claim 15 wherein said slurry includes water, said ore includes coal and refuse, and said frothing agent includes about 2% by volume of No. 2 fuel oil, a small but effective amount of butoxy ethoxy proponal.

25. Apparatus for beneficiating coal from raw input, comprising:

means for classifying said raw input to a size range of 12 mesh×0;

means for mixing said raw input with water and a frothing agent to form a slurry;

means for mixing air under pressure with said slurry to produce an aerated slurry;

means for expelling said aerated slurry into a closed vessel containing a fluid medium at a predetermined level to cause bubbles to percolate upwardly through the medium and to form a coal-rich froth fraction on the fluid;

means in said vessel providing an underflow siphon having an upwardly opening entrance located above said expelling means and below said fluid level for withdrawing a refuse-rich fraction from said vessel;

means extending across said vessel between said fluid level and said underflow opening for flowing a plurality of streams of fluid transversely through said fluid for controlling the upward percolation of said coal-rich fraction;

means connected to said closed vessel above said fluid level for receiving said coal-rich froth fraction and for separating the same by gravity into a gaseous air component and a coal-rich remainder;

means connected to said froth receiver and separator for withdrawing said gaseous air component, compressing the same, and reintroducing the same to said mixing means; and means connected to said froth receiver and separator for removing said coal-rich remainder and further separating the same into fine coal particles and a liquid;

whereby coal is separated from refuse in a continuous process.

26. Apparatus according to claim 25 including a secondary vessel like in construction to said first-mentioned vessel and having like air mixing means and air expelling means, means connecting said underflow siphon of said first vessel and the bottom of said froth receiver and separator to said air mixing means of said secondary vessel, and means for withdrawing from said secondary vessel a coal-rich froth fraction and a refuse-rich fraction.

27. Apparatus according to claim 25 including valve means connected to said underflow siphon for regulating the rate of flow of refuse-rich fraction from the vessel through the underflow siphon.

28. Apparatus according to claim 25 including means in the bottom of said vessel providing a drain, and valve means connected to said drain means.

29. Apparatus according to claim 25 wherein said underflow siphon has an upstanding stem and an enlarged funnel-shaped entrance having an area exceeding half the cross-sectional area of said vessel and being located above about the middle of the vessel.

30. A vessel for use in a froth flotation process to separate ores, comprising:

a cylindrical wall adapted to contain a separating medium at a predetermined operating level;

a cover disposed on top of said wall to provide a head space above said medium level for receiving froth containing a first ore fraction;

an outlet in said cover for permitting froth to be withdrawn from said head space:

an underflow siphon assembly mounted centrally within said vessel, said siphon assembly having an upstanding hollow stem and a conical entrance for collecting a second ore fraction;

a valve connected to said stem for controlling the rate of discharge of said second ore fraction from said vessel;

a scrubbing grid extending across said separator chamber above the level of said conical entrance for flowing an array of fluid streams in a grid pattern below the operating level of said medium;

a series of nozzles mounted in said vessel adjacent said underflow siphon stem for expelling an aerated slurry downwardly into said medium; and a drain provided at the bottom of said vessel to afford removal of solids generated in the course of operation of the vessel.

31. The vessel according to claim 30 wherein said vessel wall is necked-down along said underflow siphon stem and flares outwardly and upwardly below said conical entrance to form an annular flow space for creating desirable flow patterns within the vessel.

32. The vessel according to claim 31 wherein said vessel has a diameter greater than the vertical dimension of said cylindrical wall, and said siphon entrance has a cross-sectional area greater than half the cross-sectional area of said cylindrical wall.

* * * * *